US009193497B2

(12) United States Patent
Tibbels

(10) Patent No.: US 9,193,497 B2
(45) Date of Patent: Nov. 24, 2015

(54) DISPLAY READY CONTAINER

(71) Applicant: Innovative Packaging Designs L.P., Montgomeryville, PA (US)

(72) Inventor: Brian J. Tibbels, Cochranville, PA (US)

(73) Assignee: Innovative Packaging Designs L.P., Montgomeryville, PA (US)

( * ) Notice: Subject to any disclaimer, the term of this patent is extended or adjusted under 35 U.S.C. 154(b) by 0 days.

(21) Appl. No.: 13/758,010

(22) Filed: Feb. 4, 2013

(65) Prior Publication Data

US 2013/0199965 A1 Aug. 8, 2013

Related U.S. Application Data

(60) Provisional application No. 61/595,060, filed on Feb. 4, 2012.

(51) Int. Cl.

| | |
|---|---|
| ***B65D 5/52*** | (2006.01) |
| ***B65D 5/48*** | (2006.01) |
| ***B65D 5/32*** | (2006.01) |
| ***B65D 5/54*** | (2006.01) |
| ***B65D 5/16*** | (2006.01) |

(52) U.S. Cl.

CPC .. *B65D 5/52* (2013.01); *B65D 5/16* (2013.01); *B65D 5/32* (2013.01); *B65D 5/328* (2013.01); *B65D 5/48002* (2013.01); *B65D 5/48014* (2013.01); *B65D 5/54* (2013.01)

(58) Field of Classification Search

CPC .... B65D 5/5445; B65D 5/4275; B65D 5/328; B65D 5/32; B65D 5/5495; B65D 5/4279; B65D 5/4291; B65D 5/427; B65D 5/54

USPC ..... 206/774, 736; 229/241, 240, 125.33, 229/211, 122.21

See application file for complete search history.

(56) References Cited

U.S. PATENT DOCUMENTS

| | | | | |
|---|---|---|---|---|
| 5,505,368 | A * | 4/1996 | Kanter et al. | 229/122.32 |
| 5,507,430 | A * | 4/1996 | Imhoff | 229/125.19 |
| 5,842,576 | A * | 12/1998 | Snow | 206/736 |
| 6,325,282 | B1 | 12/2001 | Kanter et al. | |
| 6,371,365 | B1 * | 4/2002 | Doucette et al. | 229/120.011 |
| 7,296,731 | B2 * | 11/2007 | Auclair et al. | 229/242 |
| 7,484,654 | B2 | 2/2009 | Tibbles et al. | |
| 7,798,391 | B2 | 9/2010 | Tibbels et al. | |
| 8,430,297 | B2 * | 4/2013 | Gatrost et al. | 229/240 |
| 8,590,773 | B2 * | 11/2013 | Moreau et al. | 229/211 |
| 2010/0264200 | A1 * | 10/2010 | Jacomelli et al. | 229/122.21 |
| 2010/0276333 | A1 * | 11/2010 | Couture | 206/774 |
| 2012/0160735 | A1 * | 6/2012 | Waidelich | 206/736 |

FOREIGN PATENT DOCUMENTS

FR WO-2009/133279 A2 * 11/2009 ..... B65D 5/64

* cited by examiner

*Primary Examiner* — Anthony Stashick
*Assistant Examiner* — Mollie Llewellyn
(74) *Attorney, Agent, or Firm* — Fox Rothschild LLP

(57) ABSTRACT

A container preassembly which has an inner sleeve in a flat unopened position disposed within an outer sleeve in a flat unopened position, where in the inner sleeve is substantially shorter than the outer sleeve. The two sleeves are adapted for form the top and bottom ends of the final opened container. The inner sleeve is cut so that gaps at the top of the inner sleeve form notches at the corners of the final opened container. The shorter outer sleeve rests on these notches preventing the pieces from shifting during the manufacturing process and to allow the preassembly to be folded into the final container using current machine technology.

11 Claims, 10 Drawing Sheets

100
101
102
103
104a
104b
105
106
106a
106b
106c
107
108
109
110
111
112
113
114
115
115a
116
117
118
119
120
130
135
180
H1
H2
FL-1
FL-2
200
201
202
203
204a
204b
205
205a
205b
205c
206
207
208
210
211
212
220
222

FIG.5
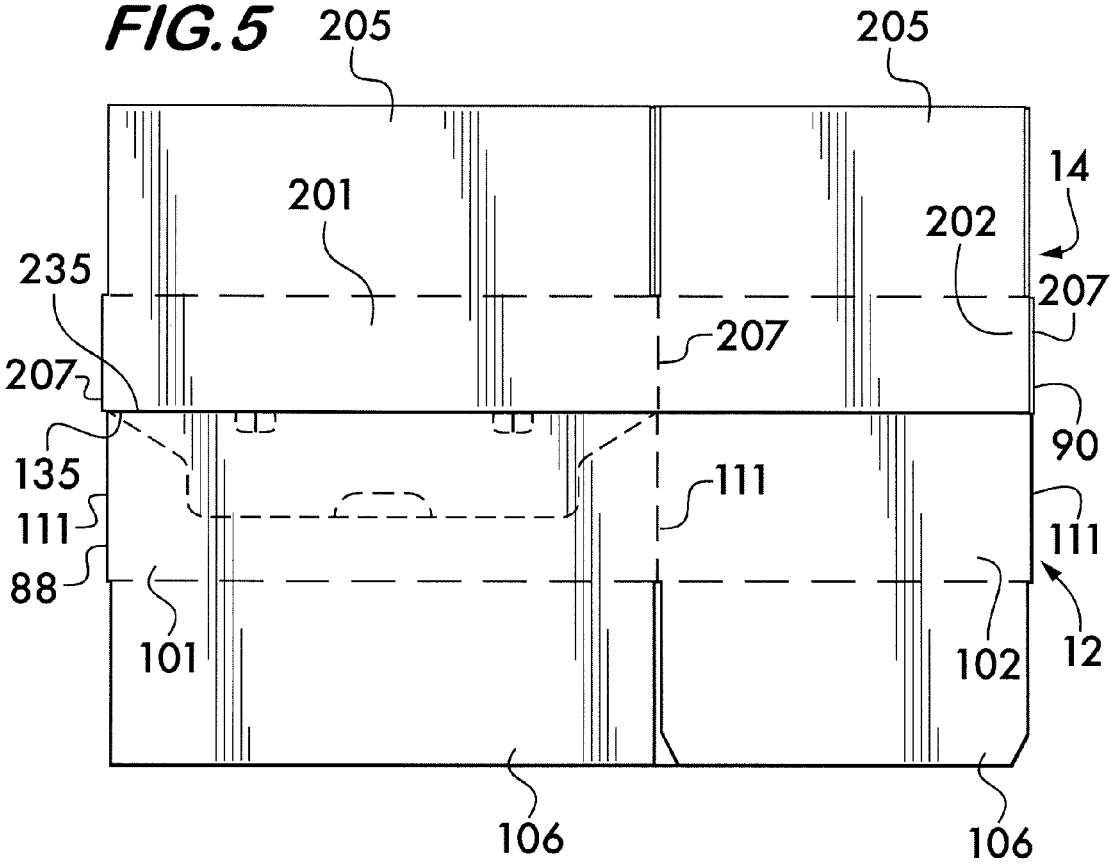
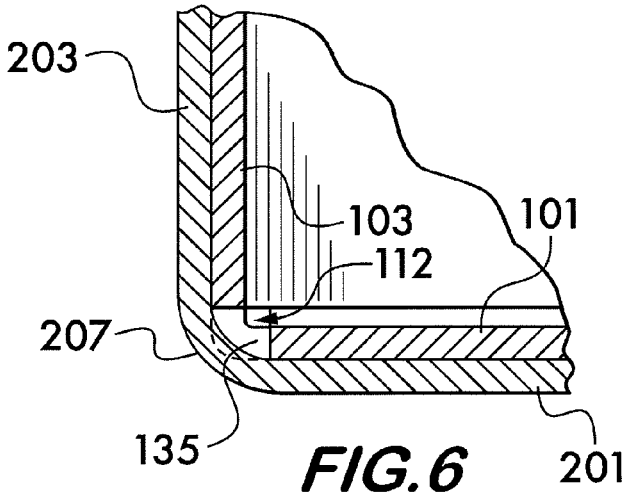
FIG.6

DISPLAY READY CONTAINER

This application claims the benefit of U.S. Provisional Patent Application No. 61/595,060 filed on Feb. 4, 2012, the contents of which are incorporated herein by reference.

BACKGROUND OF THE INVENTION

1. Statement of the Technical Field

The invention pertains to containers used for packaging, shipping, and displaying goods. More particularly, the invention relates to containers formed from at least two sections.

2. Description of the Related Art

Two piece containers are extremely popular and in widespread use. Typical two piece containers have separate top and bottom sections formed from separate blanks. A first section has side walls and flaps for forming the container's bottom. A second section has side walls and flaps for forming the top, and fits over the side walls of the bottom section to enclose the interior of the container. These top and bottom sections are sometimes referred to as half slotted containers since both are necessary to form a single fully enclosed container. In contrast, a regular slotted container is formed from a single blank section having both bottom and top forming flaps.

Two piece containers are extremely useful for packaging, storing, shipping, and displaying goods. After the goods are placed into the interior of the bottom section, the top section is placed over the bottom section to fully enclose the contents. The top and bottom sections can then be secured together for shipping.

Two piece containers are particularly useful as shipping-display containers. Used to package and ship goods for retail, the outside face of the bottom section can be printed and/or designed with promotional information suitable for display on the retail floor. The retailer simply removes the top section of the container and places the bottom display section containing the goods on the retail floor. Unlike regular slotted containers, no cutting or tearing of the container is required to open it. This type of container is very popular for food items which are easily displayed in the bottom display section.

One disadvantage of present two piece containers is the number of steps necessary to assemble the container. The user begins with the two separate container sections, both in a flat unfolded position. The bottom section is opened to form the sides and its flaps folded and secured to form the container bottom. The top piece is likewise opened and its flaps folded and secured to form the top. After the bottom section is loaded with the goods, the top section, slightly larger than the bottom, is placed over the bottom section to form a completely enclosed container. If desired, the two sections can be secured together.

U.S. Pat. No. 5,505,368 to Kanter et al., teaches a two section container with an inner sleeve and an outer sleeve, both adapted to form the two ends of the container in an aligned relationship of the final open container. This allows preassembly of a container, by an automated process, into a "knockdown" that may be opened to form the final container without requiring further adjustment. Once opened, the flaps for forming the container bottom are folded to create a container ready for use. This container has many advantages, but further improvements are believed possible. Such improvements would include using less material to create less waste while lowering costs, and also maintaining strength while using less material.

SUMMARY OF THE INVENTION

The present invention improves the two piece container to create one that is more useful and cost effective.

In at least one aspect, the present invention provides a container preassembly for opening into a container having top and bottom ends. The container preassembly includes an unopened outer sleeve having panels for forming outer sleeve sides, and flaps integrally connected to the panels for forming one end of the container and an unopened inner sleeve positioned inside the outer sleeve, the inner sleeve having panels for forming inner sleeve sides and flaps integrally connected to the panels for forming the other end of the container. At least one tear away line is defined through one of the panels of the inner sleeve to define at least one tear away section of the inner sleeve. The outer and inner sleeves are secured together in an aligned relationship of the opened container wherein the securement of the sleeves is defined between respective portions of the outer sleeve and the at least one tear away section of the inner sleeve.

In another aspect, the present invention provides a container preassembly adapted to open into a container having top and bottom ends. The container preassembly includes an outer sleeve in a flat unopened position and having panels for forming outer sleeve sides, and flaps for forming one end of the opened container, wherein a respective fold line is defined between adjacent outer sleeve panels. An inner sleeve is in a flat unopened position and have panels for forming inner sleeve sides, and inner sleeve flaps for forming the other end of the opened container, wherein a respective fold line is defined between adjacent inner sleeve panels within a lower portion thereof and a respective slot is defined between adjacent inner sleeve panels within an upper portion thereof, each slot co-linear with a respective fold line. The outer and inner sleeves are permanently secured together in an aligned relationship of the container when opened such that the outer sleeve fold lines are positioned over the respective inner sleeve slots.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

Embodiments will be described with reference to the following drawing figures, in which like numerals represent like items throughout the figures, and in which:

FIG. 5 is a side view of the reverse side of a knockdown from that of FIG. 4;

FIG. 6 is a cross-sectional view along the lines 6-6 in FIG. 1;

DETAILED DESCRIPTION

The present invention is described with reference to the attached figures. The figures may not be drawn to scale and they are provided merely to illustrate an exemplary embodiment of the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operation are not shown in detail to avoid obscuring the invention. The present invention is not limited by the illustrated ordering of acts or events, as some acts may occur in different orders and/or concurrently with other acts or events. Furthermore, not all illustrated acts or events are required to implement a methodology in accordance with the present invention.

The word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is if, X employs A; X employs B; or X employs both A and B, then "X employs A or B" is satisfied under any of the foregoing instances.

Figure 1:
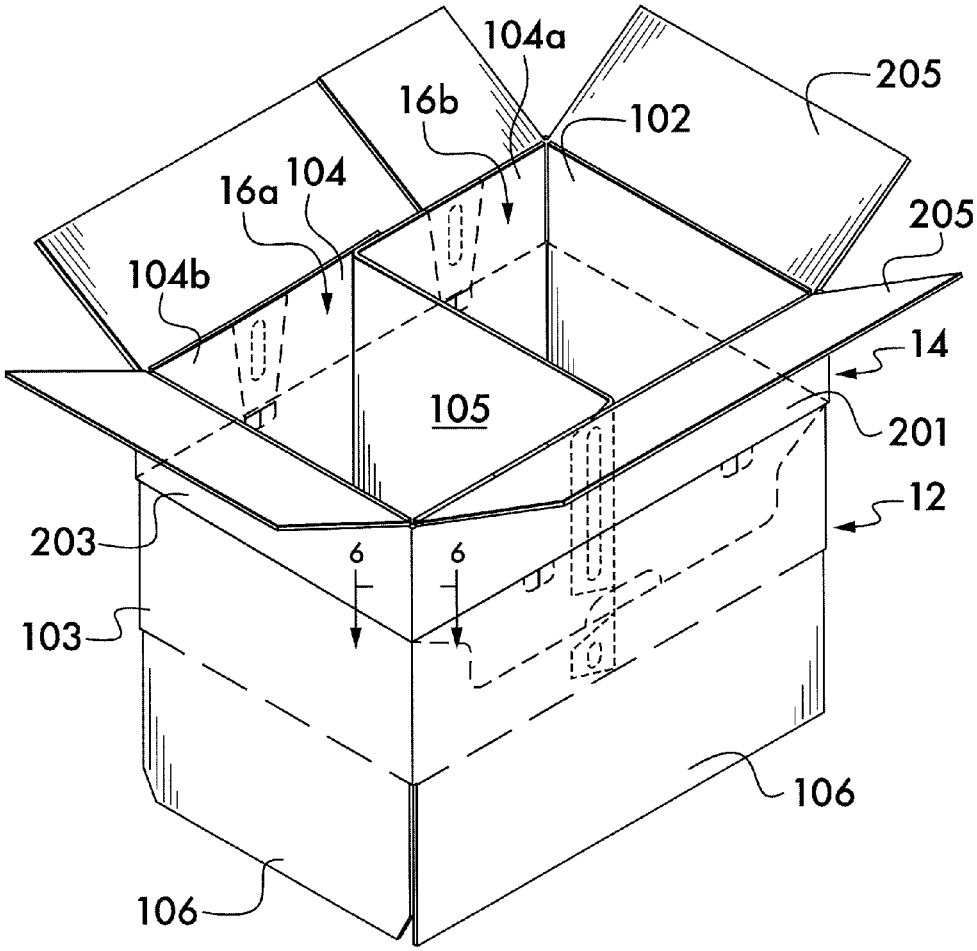
FIG. 1 is a top perspective view of the assembled container with the top and bottom flaps unfolded.

Referring to FIG. 1, an opened container 10 is shown with its top and bottom forming flaps unfolded. Container 10 comprises inner (lower) sleeve 12 and outer (upper) sleeve 14. The inner sleeve 12 includes side panels 101, 102, 103 and 104, panel 104 being formed by panels 104*a* and 104*b*. The inner sleeve further includes bottom forming flaps 106 integrally attached to respective side panels 101-104. The illustrated embodiment further includes a divider panel 105 separating the interior of the container 10 into two sections 16*a* and 16*b* as shown.

The outer sleeve 14 forms a removable cover for the inner sleeve 12 and includes side panels 201, 202, 203 and 204, panel 204 being formed by panels 204*a* and 204*b* (not shown in FIG. 1). The outer sleeve further includes top forming flaps 205 integrally attached to respective side panels 201-204. As will be described below, the inner and outer sleeves 12, 14 are formed separately from blanks 100 and 200 which are assembled into a knockdown form which can be opened into the final container 10 as shown in FIG. 1.

Figures 2A, 2B:
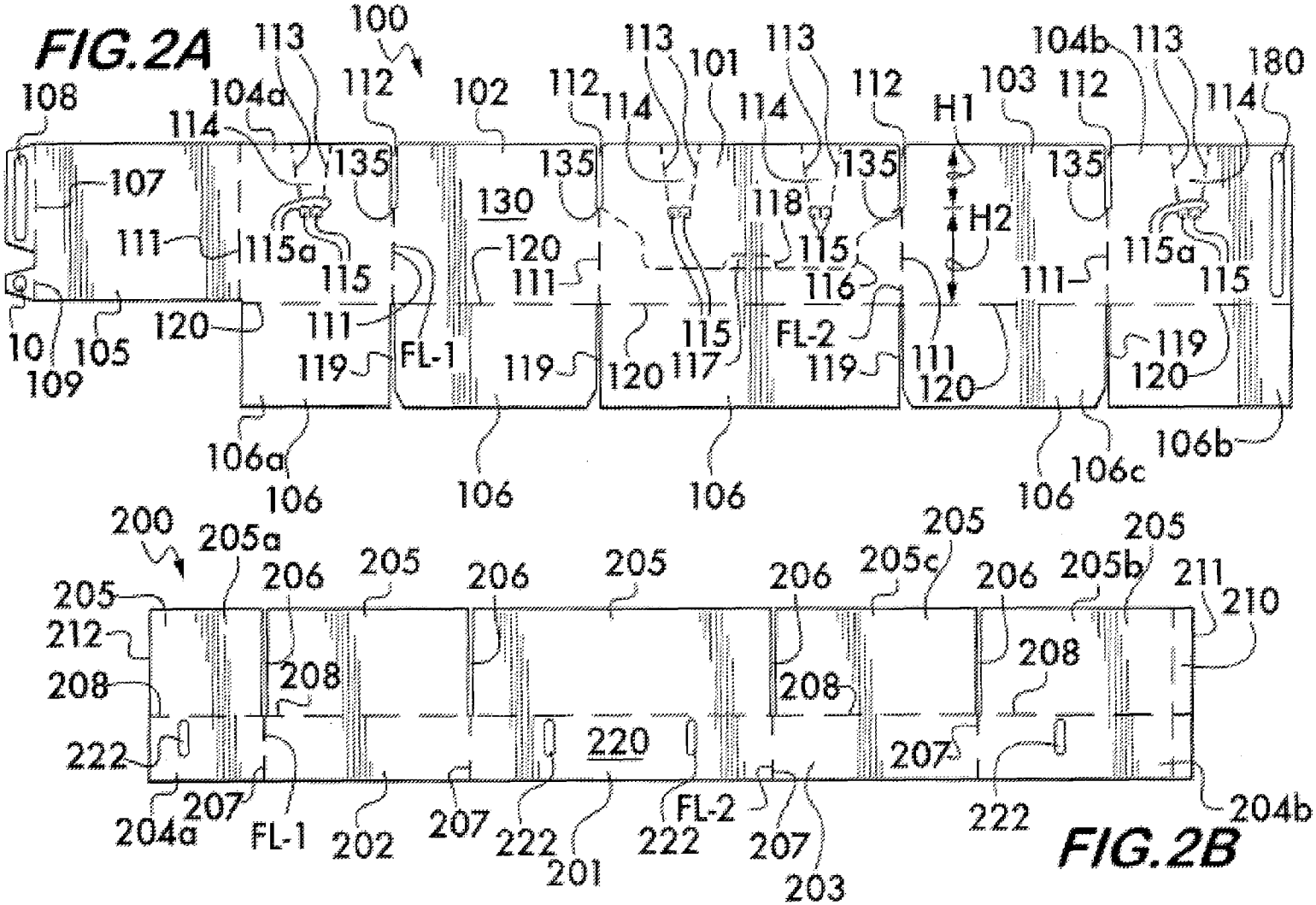
FIG. 2A is a plan view of a blank section for forming the inner section of the container.
FIG. 2B is a plan view of a blank section for forming the outer section of the container.

Referring to FIG. 2A, a blank 100 for forming the inner sleeve 12 of the display ready container 10 includes the side panels 101, 102, 103, 104*a*, and 104*b* for forming the sides of the container 10 (104*a* and 104*b* form side 104 as described below), and further includes the divider panel 105. The panels are preferably integrally formed and separated by score lines (crease) 111 at the lower portion of the panels 101-104 and slots or gaps 112 at the upper portion of the panels 101-104. The score lines 111 are impressed into the blank 100 as shown to act as a fold line and aid in folding. Slots or gaps 112 separate the upper portions of adjacent side panels, the purpose of which will be described below. Slots or gaps 112 have a bottom 135 after which the score lines 111 extend. The upper portions have a height H1 and the lower portions have a height of H2. The ratio H1/H2 is preferably less than or equal to 0.5 and more preferably is in the range of about 0.25 to 0.4, although other ratios may be utilized. Bottom forming flaps 106 are integrally connected to the lower portions of the side panels by score (fold) lines 120, and are separated from each other by slots 119.

Tear away lines 113 formed by a series of perforations or cuts are provided on the front side panel 101 and the rear side panel 104 to form tear away sections 114. Tear away sections 114 facilitate separating the inner and outer sleeves 12, 14 as further described below. While tear away sections 114 are illustrated on the front and rear side panels 101, 104, they may additionally or alternatively be provided on the right and left side panels 102, 103. Below each of the tear away sections 114 is a pair of push in tabs 115 formed preferably by a continuous perforation line or cut encircling the two adjacent tabs with the exception of small uncut sections 115*a* along the left side of the left tab and along the right side of the right tab of each of the pair of tabs as seen in FIG. 2A. The uncut sections 115*a* act as a hinge about which the individual tabs 115 can fold. The push tabs are pushed in using a finger to gain access to the tear away sections 114 from inside the container 10 to enable removal of the tear away sections 114 as further described below.

The side panel 101 of the illustrated embodiment further includes a removable display section 101*a* that can be removed to form a display opening in the container 10. The removable section 101*a* is formed by perforations and cut lines 116. A push in section 117, formed by line of perforations 118, can be pushed in to allow the user to grab the removable section 101*a* from inside the container 10 and pull it outwardly for removal. The divider panel 105 has glue tabs 108, 110 having fold lines 107, 109, respectively, for attaching to the inside face of the side panel 101. Fold line 109 is preferably formed with a score, fold line 107 preferably formed by a series of perforations so as be easily tearable for removal with the removable section 101*a*.

It is seen that the inner sleeve 12 is formed by folding the blank 100 along the fold lines (score) 111 to form the inner sleeve sides 101-104. (It is recognized that some of the fold lines 111 form the side corners of the inner sleeve 12). Side panels 104*a* and 104*b* are secured together as shown in FIG. 1 to form the back side and to make the continuous sleeve 12. The divider panel 105 is folded along its fold (score) lines 107,109, and its glue tabs 108,110 secured to the side panel 101. Any suitable means for securing the panels together may be used as is well known in the art, including adhesives such as glue.

Referring to FIG. 2B, a blank 200 for forming the outer sleeve 14 includes the side panels 201, 202, 203, 204*a*, and 204*b* for forming the side walls of the sleeve 14 (panels 204*a* and 204*b* are combined to form panel 204). Fold lines comprising score lines 207 are impressed between the side panels to aid in folding the blank 200, and which form the side corners of the outer sleeve 14. The flaps 205 for forming the top 18 are separated by slots 206 and integrally attached to the side panels at a score line 208. A glue tab area 210 is provided to secure one end 211 of the blank 200 with the other end 212 when forming the continuous sleeve 14.

The blanks 100, 200 are each preferably formed from a unitary piece of corrugated paperboard. Once formed, the blanks 100, 200 are preferably combined and folded to form a flat preassembled container, called a knockdown (FIG. 4), that can be stored and shipped efficiently and which is easily erected into an open container for shipping goods. Illustrated in FIGS. 3-12 is an exemplary method of assembling and using the flat preassembled container.

Figure 3A:
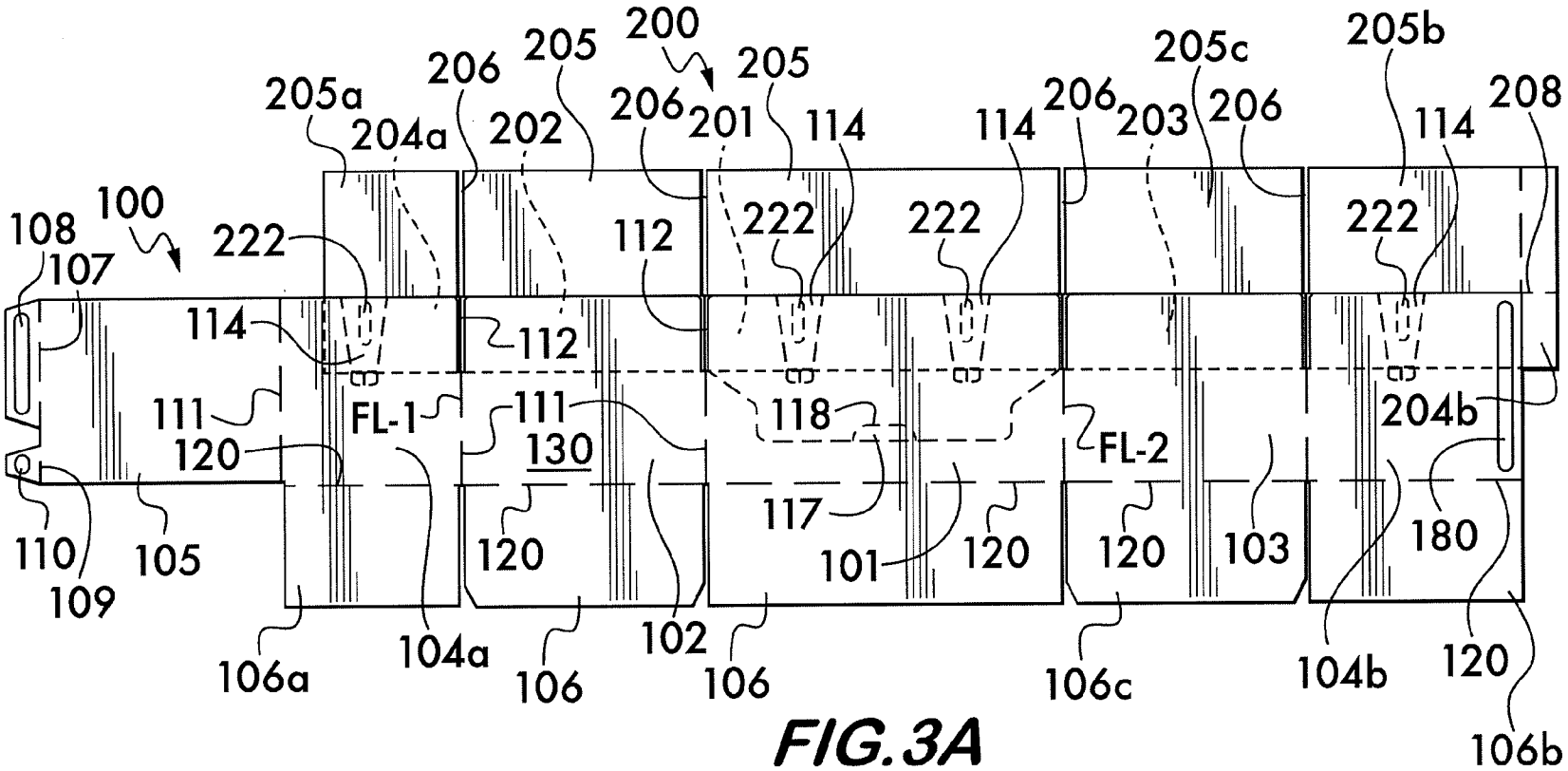
FIG. 3A is a view of the inner section positioned over the outer section for assembly into a knockdown.

Referring first to FIG. 3A, the outer blank 200 is laid flat with its inner face 220 facing upwardly as shown. Adhesive, such as a hot melt glue, is provided on the inner face 220 in areas 222 which will align with the tear away sections 114 of the inner sleeve 100 (FIG. 2A). The inner blank 100 in a flat unfolded position (as shown in FIG. 2A), with its inner face 130 facing upwardly and an outer face, not shown, facing the inner face 220 of the outer blank 200, is placed on top of the inside face 220 of the outer blank 200 in the aligned position of the final opened container such that the adhesive in areas 222 adheres to the tear away sections 114, thereby securing the two blanks 100 and 200 together. Pressure can be applied to the glued areas to ensure good adhesion between the two blank sections 100,200.

Figure 8:
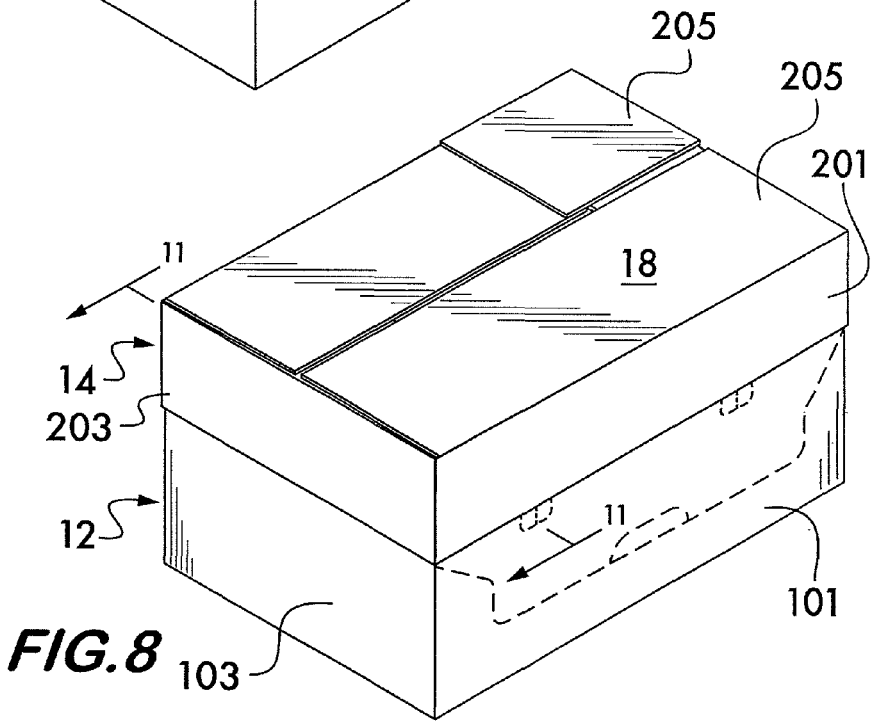
FIG. 8 is a perspective view of a completed container.
Figure 9:
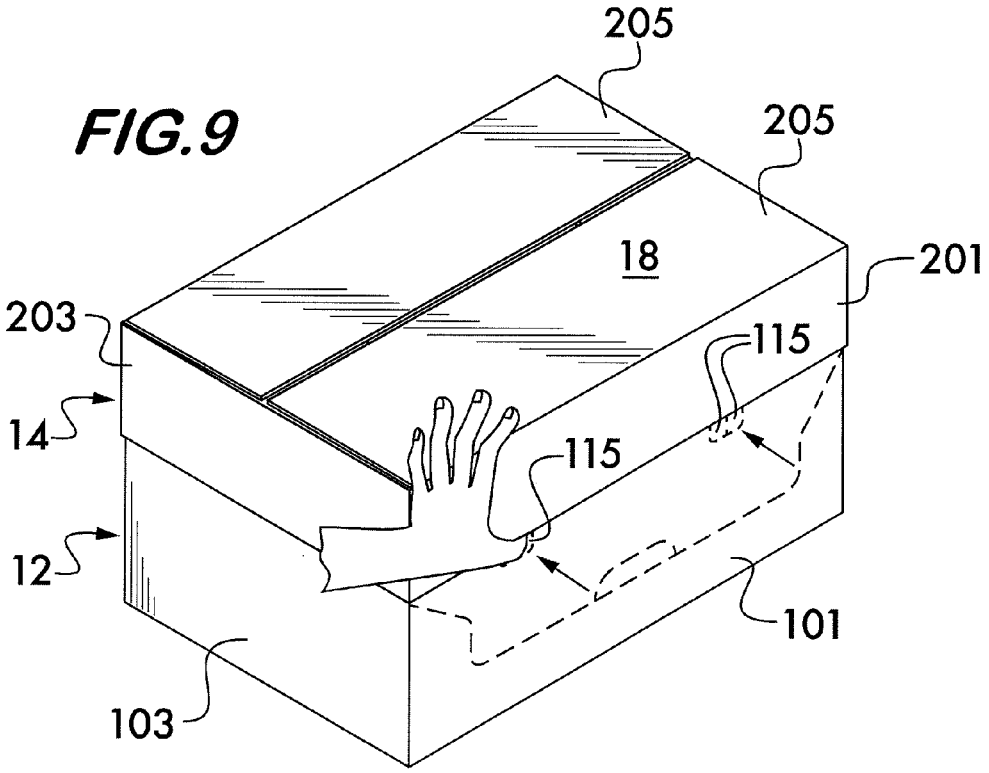
FIG. 9 is a perspective view of the completed container illustrating the initial step of separating the outer section from the inner section.

As shown, the blanks 100 and 200 are combined in the aligned relationship of the final erected (opened) container 10; i.e., the side panels of the inner blank 100 align with and are adjacent to the respective side panels of the outer blank 200 in the same relationship as the final container 10. Thus the front inner sleeve side panel 101 will align with the front outer sleeve side panel 201, the back inner sleeve side panels 104*a*, 104*b* will align with the back outer side panels 204*a*, 204*b*, etc. Moreover, the fold lines 111 and slots 112 of the inner sleeve blank 100 align with the respective fold lines 207 of the outer sleeve blank 200 to form adjacent corners of the inner and outer sleeves of the final container 10. With the fold lines 111, 207 aligned, the two sleeves 12, 14 open together as a single unit as described below. The top edge 122 of the inner blank 100 is aligned with or below the fold line 208 of the blank 200 such that the flaps 205 may be folded to form the top 18 of the final container 10 as shown in FIG. 8. Preferably, as illustrated, the top edge 122 of the inner sleeve 12 aligns with the fold line 208 about which the flaps 205 of the outer sleeve fold to form the top 18 so that the top 18 of the final container 10 is positioned just above the edge 122, thereby providing additional support for the top 18.

Figure 3B:
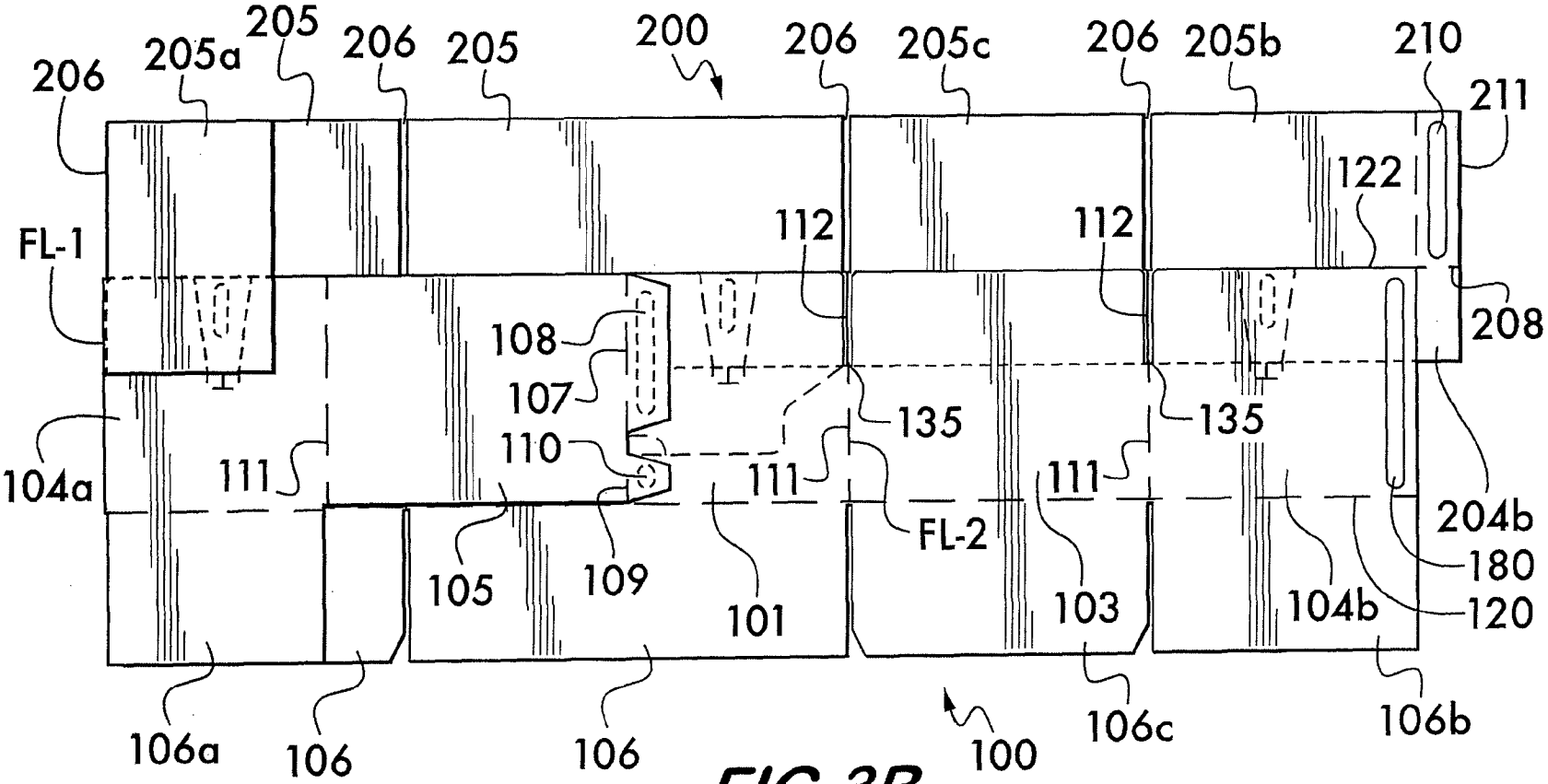
FIG. 3B is a view of the inner section positioned over the outer section showing the assembly of the container.

Referring to FIG. 3B, next adhesive is applied to the inner face 130 of glue tabs 108 and 110, and then panels 104*a*, 105, and 106*a* of the inner blank 100 and panel 204*a* and 205*a* of the outer blank 200 are folded as a unit about fold line FL-1 such that the glue tabs 108 and 110 adhere to the inside face 130 of the panel 101. Pressure can be applied to ensure good adhesion.

Figure 4:
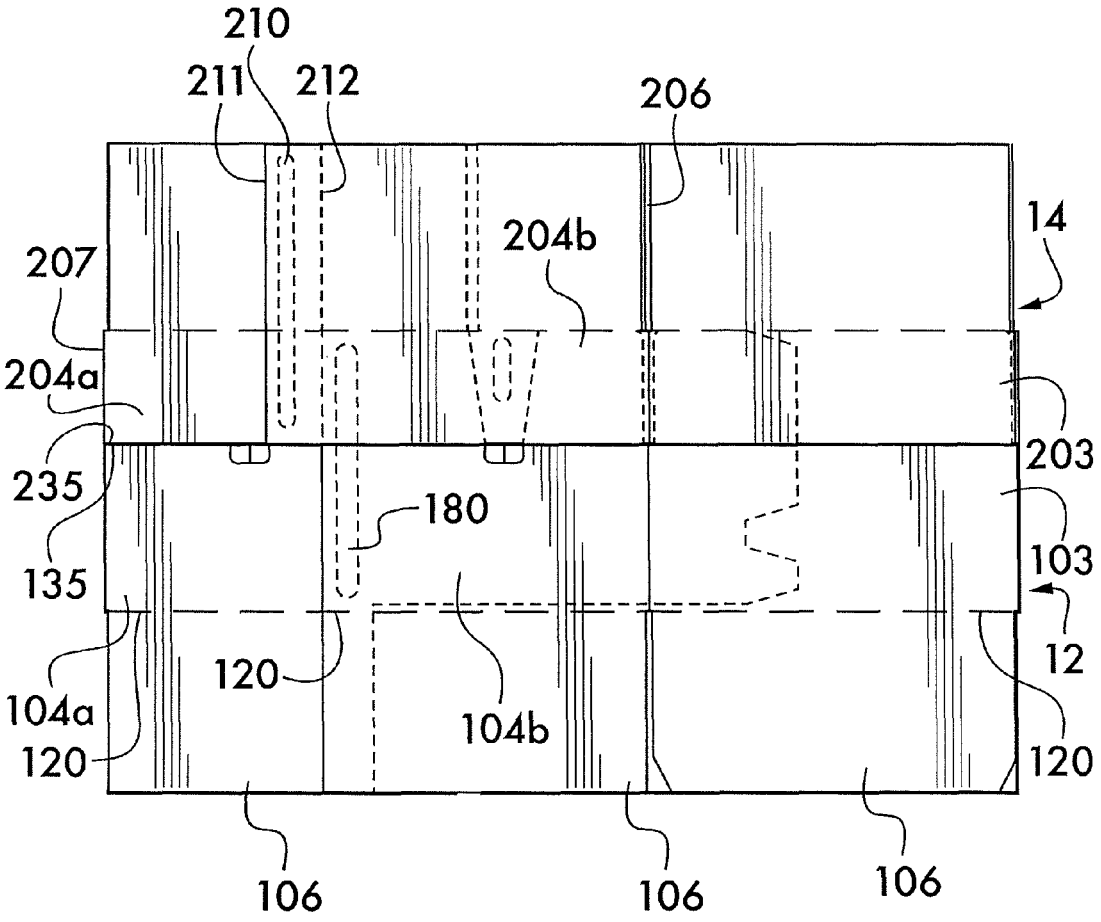
FIG. 4 is a side view of a knockdown.

Next, referring to FIGS. 3B and 4, adhesive is applied to glue area 210 of the outer blank 200 (panel 204*b*) and glue area 180 of the inner blank 100 (panel 104*b*). Panels 104*b*, 106*b*, 103 and 106*c* of the inner blank 100 and panels 204*b*, 205*b*, 203 and 205*c* of the outer blank are then folded about fold line FL-2 to form the knock down container. The adhesive in areas 180 and 210 combines the side panels 104*a* and 104*b*, and panels 204*a* and 204*b* to form the complete side panels 104 and 204 respectively. Pressure can be applied to the glued areas to ensure good adhesion. Once the outer sleeve 14 is formed and secured around the inner sleeve 12, it is seen that a flat preassembled knockdown container comprising the unopened inner and outer sleeves 12, 14 is formed. Such flat assemblies are efficiently stored and shipped in stacked form. FIG. 5 illustrates the reverse side of the knockdown showing outer sleeve 14 wrapped around inner sleeve 12. As is seen, the fold lines 207 align with the fold lines 111, and fold lines 207 are positioned over gaps 112, with the lower edges 235 of the outer sleeve 14 at score line 207 being aligned with the bottom 135 of the gap 112.

Using the container 10 is very simple and efficient. Referring to FIGS. 1 and 5, the user erects the completed flat container preassembly by pushing the ends 88, 90 toward each other until an opened container 10 is formed as shown in FIG. 1. It is seen that this opens both sleeves 12, 14 as a single unit. As mentioned above, the slots 112 of the inner sleeve 12 align with the respective fold lines 207 of the outer sleeve 14 at the container corners. As the two blanks 100, 200 are folded into the knockdown and then unfolded into the final container 10, given that the two blanks 100 and 200 are adhered together prior to the folding steps, the corners of the outer sleeve 14 will move or nest into the gaps 112 of the inner sleeve 12 during the unfolding process as shown in FIG. 6. The lower edge 235 of the sleeve 14 will rest on the edge 135 of the respective slot or gap 112. This nesting within the gaps 112 and resting of the edge 235 on the edge 135 of the gap allows for the outer sleeve 14 to firmly situate on the corners of inner sleeve 12, and provides additional strength to the overall container structure.

In this regard, the side panels 201-204*b* are substantially equal in height to the height H1 of the upper portion of the lower panels 101-104, thereby extending preferably less than 50% of the full height of the inner sleeve 12 side panels 101-104, although other ratios, including greater than 50% may be utilized. Full length side panels for the outer sleeve are not necessary for the strength normally added by the full length panels given the strength of the container. Additionally, the sleeve 14 may be constructed using thinner corrugated or paper board than the inner sleeve 12, i.e. the outer sleeve has a material thickness less than the inner sleeve. It is seen this configuration as described herein allows for side panels 201-204*b* to be constructed using less material than conventional display ready containers without sacrificing strength. Further, the gaps 112 allow the outer sleeve 14 to rest securely on inner sleeve 12 thereby preventing slippage during assembly.

Figure 7:
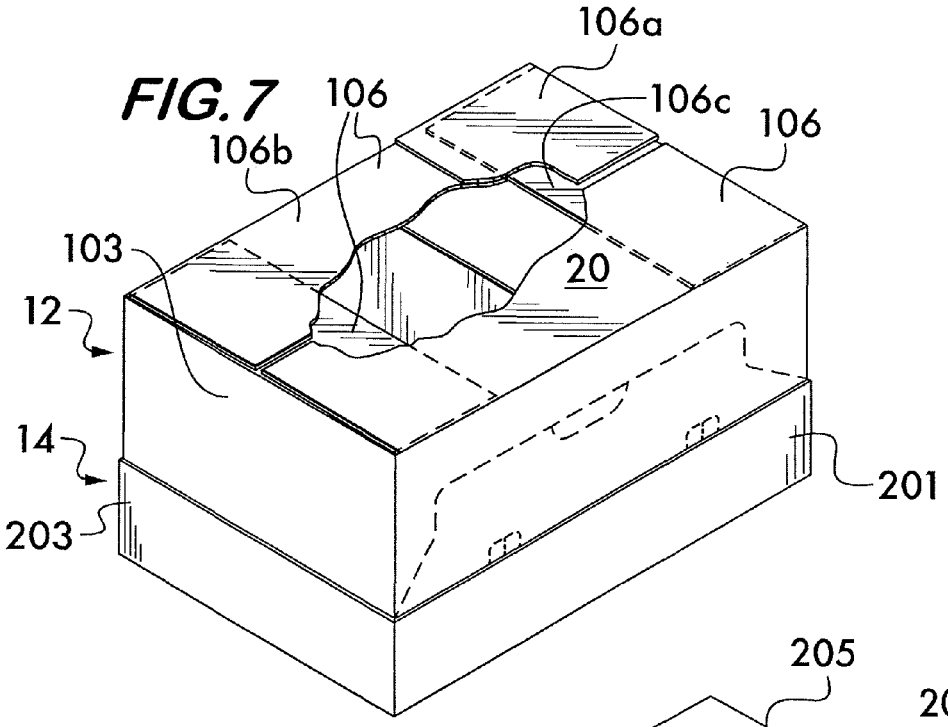
FIG. 7 is a perspective bottom view of a completed container.

After the container has been unfolded to the configuration illustrated in FIG. 1, the flaps 106 of the inner sleeve 12 are then folded and secured to form the container bottom 20 as illustrated in FIG. 7. In this configuration, the container 10 is ready to be loaded with goods. Once loaded with goods, the flaps 205 of the outer section 14 are folded and secured to form the top 18, thereby enclosing the goods within the container 10, as shown in FIG. 8.

Figure 10:
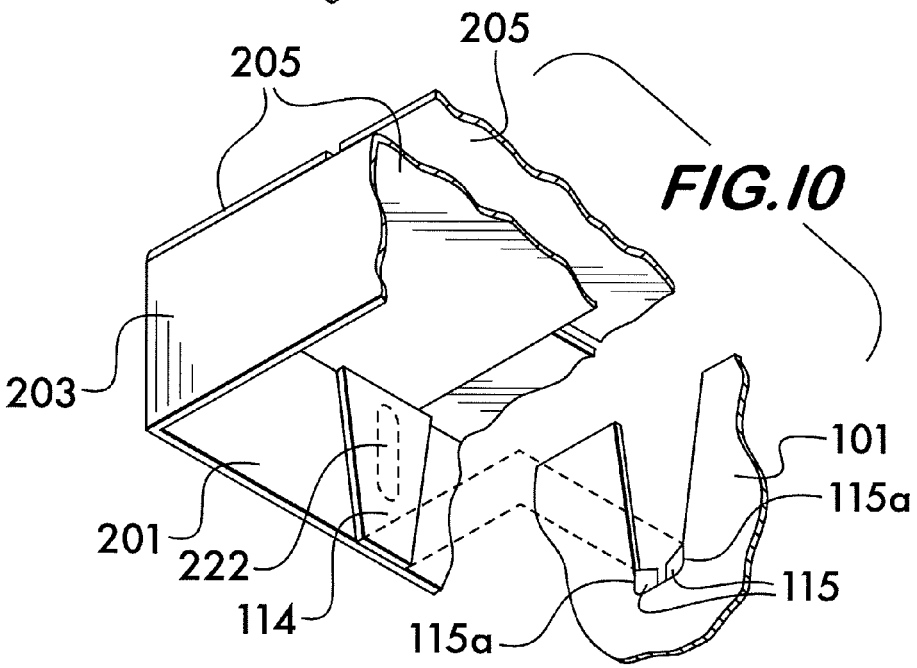
FIG. 10 is a partial cross-sectional, exploded view illustrating a portion of the outer container removed from the inner container.
Figure 11:
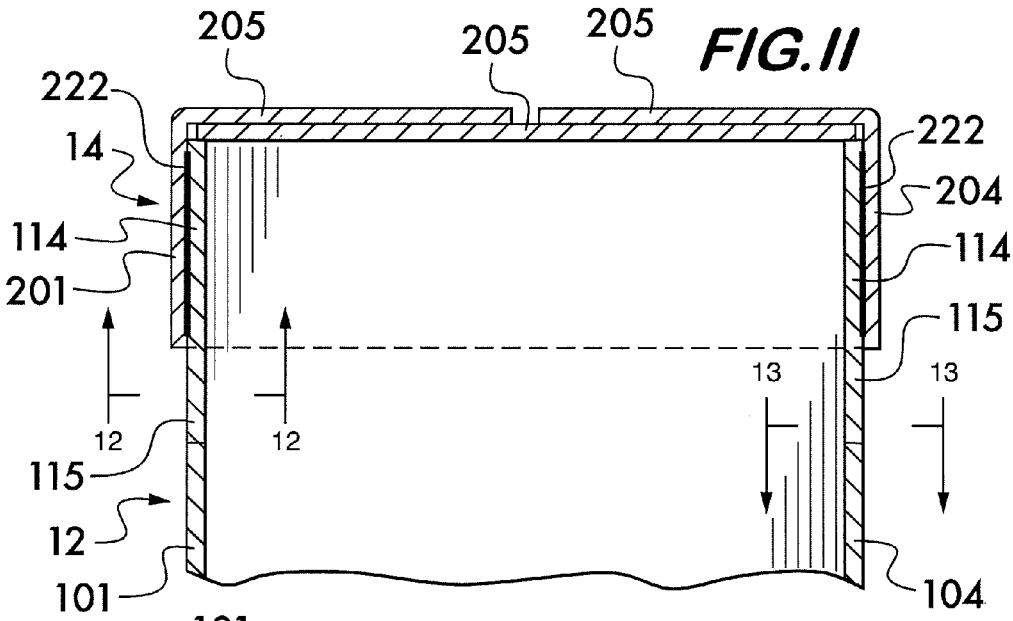
FIG. 11 is a cross-sectional view along the lines 11-11 in FIG. 8.
Figure 12:
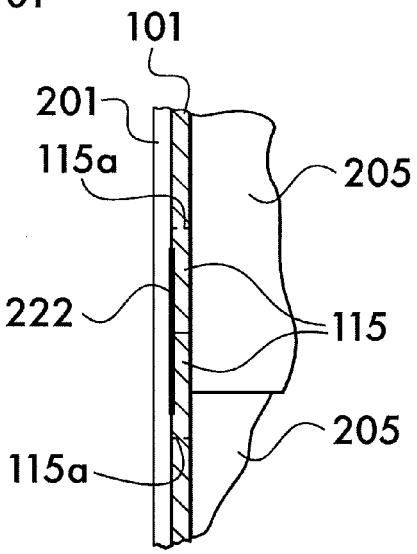
FIG. 12 is a cross-sectional view along the lines 12-12 in FIG. 11.
Figure 13:
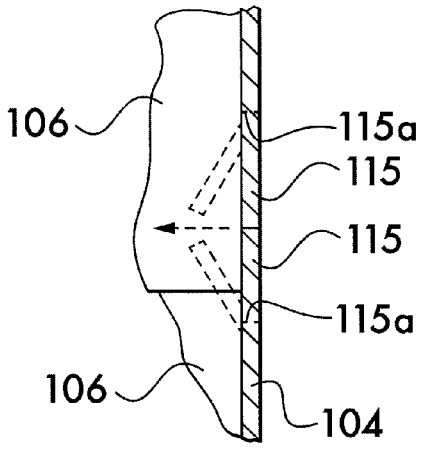
FIG. 13 is a cross-sectional view along the lines 13-13 in FIG. 11.

Referring now to FIGS. 9-13, removal of the container outer section 14 to expose the goods within is now described. The push tabs 115 are pushed in using a person's finger to access the inside wall of the tear way sections 114 above each of the push tabs 115. The user then pulls each tear away section 114 outwardly to detach the tear away sections 114 from the inner sleeve 12 along the lines 113. Since the tear away sections 114 are glued to the outer sleeve 14, once all of the tear away sections 114 are torn free of the inner sleeve 12, the outer sleeve 14 can be lifted off of the inner sleeve 12 as seen in FIG. 10.

Figure 14:
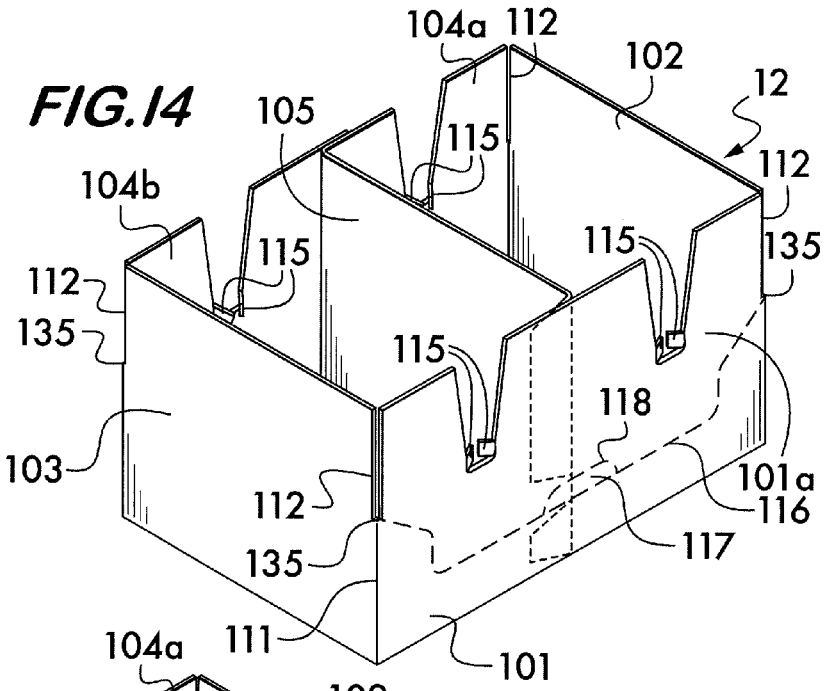
FIG. 14 is a perspective view of a completed container shown with the outer section removed.
Figure 15:
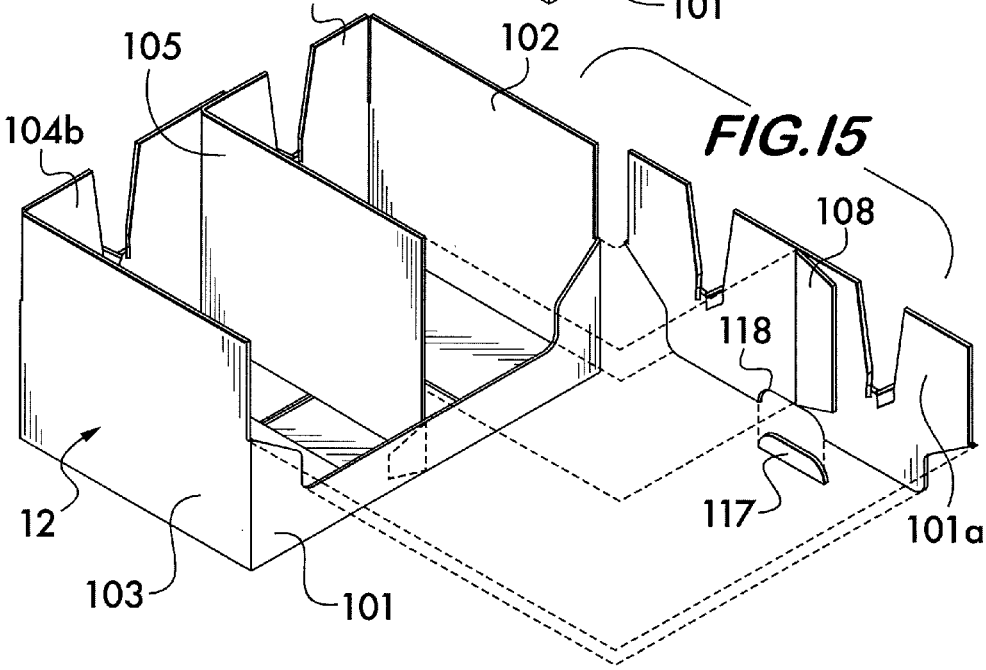
FIG. 15 is a perspective view showing the removable display panel removed.

After the outer sleeve 14 is removed, the container and its contents my be displayed without further adjustment as shown in FIG. 14. However, the removable display panel 101*a* can be removed to further expose the goods. With reference to FIGS. 14 and 15, the push in section 117, formed by line of perforations 118, can be pushed in to allow the user to grab the removable section 101*a* from inside the container and pull it outwardly for removal as shown in FIG. 15. The tear line 107 allows the glue tab 108 to be easily removed with the removable display panel 101*a*.

The present invention thereby provides a flat container preassembly which is simple and efficient to make, and which is easily erected into a completed container. Because forming the flat container preassembly as well as erecting and loading the fully formed container requires a few simple steps, the assembly and use of the container can be readily automated.

While a particular embodiment of the invention is described herein, it is not intended to limit the invention to such disclosure. Changes and modifications may be incorporated and embodied within the scope of the appended claims. For example, the illustrated embodiment shows the inner sleeve having flaps for forming the container bottom. Those skilled in the art readily recognize that the inner sleeve could be made to form the top of the container, or that the container could be positioned on its side for side loading.

Those skilled in the art will also recognize that the present invention is not limited to the blanks illustrated. Other types of blanks may include self locking flaps for forming both top and bottom, and may include fold line means between the panels other than scored lines.

Furthermore, the present invention is not limited to rectangular containers. Any suitably shaped container, having inner and outer sleeves can incorporate the invention, including, but not limited to, hexagonal and pentagonal shaped containers.

While various embodiments of the present invention have been described above, it should be understood that they have been presented by way of example only, and not limitation. Numerous changes to the disclosed embodiments can be made in accordance with the disclosure herein without departing from the spirit or scope of the invention. Thus, the breadth and scope of the present invention should not be limited by any of the above described embodiments. Rather, the scope of the invention should be defined in accordance with the following claims and their equivalents.

The terminology used herein is for the purpose of describing particular embodiments only and is not intended to be limiting of the invention. As used herein, the singular forms "a", "an" and "the" are intended to include the plural forms as well, unless the context clearly indicates otherwise. Furthermore, to the extent that the terms "including", "includes", "having", "has", "with", or variants thereof are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

I claim:

1. A container knockdown assembly for erecting into a container assembly having an inner container for holding goods and an outer cover for enclosing said inner container, said knockdown assembly comprising:

an unopened inner sleeve capable of forming said inner container when the knockdown assembly is erected, the inner sleeve having panels for forming inner sleeve sides and flaps integrally connected to the panels for forming an end of the inner container, wherein a perforation line defines a removable display portion of one of the inner sleeve panels and at least one tear away line is defined through the removable display portion of the inner sleeve to define at least one tear away section of the inner sleeve, wherein the display portion remains attached to the one of the inner sleeve panels when the outer cover is removed, wherein the inner sleeve panels have inner and outer faces, with the inner faces adjacent one another;

an unopened outer sleeve capable of forming the outer cover when the knockdown assembly is erected, said outer sleeve having panels for forming outer sleeve sides, and flaps integrally connected to the panels for forming an end of the outer cover, wherein the outer sleeve panels having inner and outer faces, with the inner faces of the outer sleeve panels adjacent respective ones of the outer faces of the inner sleeve panels; and the outer and inner sleeves are secured together in an aligned relationship of the opened container, the securement defined between respective portions of the outer sleeve and the at least one tear away section of the inner sleeve.

2. The container preassembly of claim 1 comprising at least two tear away sections, with at least one of the tear away sections defined in a first of the inner sleeve panels and at least on other of the tear away sections defined in a second of the inner sleeve panels.

3. The container preassembly of claim of claim 2 wherein the first of the inner sleeve panels is opposite from the second of the inner sleeve panels.

4. The container preassembly of claim 1 wherein each of the inner sleeve panels has a top edge and each of the at least one tear away sections extends from the top edge.

5. The container preassembly of claim 4 wherein each of the at least one tear away sections has a trapezoidal shape narrowing away from the top edge.

6. The container preassembly of claim 1 wherein a push through tab is positioned adjacent to each of the at least one tear away sections.

7. The container preassembly of claim 6 wherein each push through tab is hingedly connected to the respective inner sleeve panel.

8. The container preassembly of claim 6 wherein each of the inner sleeve panels has a top edge, each of the push through tabs is located a given distance from the respective top edge and each outer sleeve panel has a height less than the given distance.

9. The container preassembly of claim 8 wherein each inner sleeve panel has a height which is at least twice the height of the outer sleeve panels.

10. The container preassembly of claim 1 wherein a push through section is defined in the removable display portion by a perforation line.

11. The container preassembly of claim 1 wherein a respective fold line is defined between adjacent outer sleeve panels; and wherein a respective fold line is defined between adjacent inner sleeve panels within a lower portion thereof and a respective gap is defined between adjacent inner sleeve panels within an upper portion thereof, each gap colinear with a respective fold line; and the outer and inner sleeves are permanently secured together such that the outer sleeve fold lines are positioned over the respective inner sleeve gaps.

* * * * *